United States Patent [19]

Young

[11] 4,040,797

[45] Aug. 9, 1977

[54] ARSENIC CONTAINING FUELS

[75] Inventor: Dean Arthur Young, Yorba Linda, Calif.

[73] Assignee: Union Oil Company of California, Los Angeles, Calif.

[21] Appl. No.: 669,314

[22] Filed: Mar. 22, 1976

[51] Int. Cl.[2] ..... C10L 1/8

[52] U.S. Cl. ..... 44/68; 44/51; 44/67

[58] Field of Search ..... 44/67, 51, DIG. 3, 5, 44/4, 68; 208/253, 251 R, 251 H

[56] References Cited

U.S. PATENT DOCUMENTS

| | | | |
|---|---|---|---|
| 3,483,118 | 12/1969 | Gleim et al. | 208/253 |
| 3,933,624 | 1/1976 | Myers | 208/251 H |

FOREIGN PATENT DOCUMENTS

| | | | |
|---|---|---|---|
| 761,378 | 11/1956 | United Kingdom | 44/DIG. 3 |

*Primary Examiner*—Daniel E. Wyman
*Assistant Examiner*—Mrs. Y Harris-Smith
*Attorney, Agent, or Firm*—Gregory F. Wirzbicki; Lannas S. Henderson; Richard C. Hartman

[57] ABSTRACT

Arsenic containing fuel compositions are disclosed that will, upon combustion, leave an ash that retains substantial proportions of said arsenic, thereby reducing its dissemination into the atmosphere. This result is obtained by adding to the fuel small amounts of a Mg, Ba, Zn, or Ni component. Also disclosed are certain fuel compositions containing both Mg and Zn additives that produce an ash containing arsenic in an essentially insoluble form.

9 Claims, No Drawings

ARSENIC CONTAINING FUELS

BACKGROUND OF THE INVENTION

1. Field of the Invention

This invention relates to a method for reducing the amount of arsenic emitted as a sublimate from the combustion of a fuel containing arsenic. It also relates to improved fuel compositions that will, when combusted, leave an ash that retains substantial proportions of the arsenic originally present in said fuel composition.

2. Prior Related Art

Many fuels such as crude shale oil, coal tar distillates, and certain coals contain appreciable proportions of arsenic. When continuously burned from a stationary source, such as a power plant, these fuels emit arsenic as a sublimate which, upon condensation, can act as a carcinogen and, possibly, a poison. Also, by condensing in a form which is usually water soluble, soil run-off may increase the arsenic concentration of the local water supply to intolerable levels.

Additionaly, even the presence of arsenic in the air is a source of concern. In the United States, proposed OSHA regulations would limit the arsenic concentration in the air to which workmen could be exposed for 8 hours to no more than 0.002 mg/m$^3$. This limit may be difficult to meet, especially for power plants and the like that burn arsenic containing fuels. For example, it is reported in *Chemical abstracts,* Vol. 72, 1970, Abstract No. 24286 K that two Russian power plants burning arsenic containing coals emitted sufficient arsenic to increase the arsenic concentration in the air to a maximum of 0.003 and 0.010 mg/m$^3$ at a distance of 1 km from the respective plant sites. Despite the obvious problems relating to the discharge of such high concentrations of arsenic, the only proposed solution reported in the Abstract was to increase the height of the power plant stacks, thereby dispersing the arsenic over a wider area.

Other attempts to prevent arsenic emissions under such circumstances have focused on removing the arsenic from the fuel itself. As an example, it is known that arsenic can be removed from shale oils by passing them over a nickel-molybdenum catalyst under hydrotreating conditions. However, in addition to their high maintenance and capital costs, such processes are useless for removing arsenic from coals.

Therefore, it is one objective of the invention to provide a method for burning an arsenic containing fuel, including coals, so as substantially to reduce the arsenic sublimate emissions produced therefrom. It is another objective to provide arsenic containing fuel compositions that will, upon combustion, leave an ash retaining substantial proportions of said arsenic. It is another objective to retain the arsenic in said ash in a form that is essentially water insoluble or unleachable, thereby rendering it innocuous to soils and water supplies. Other objectives and advantages will appear from the specification herein.

SUMMARY OF THE INVENTION

It has now been discovered that by adding suitable components of Mg, Ba, Zn, Ni, and combinations thereof, to fuels containing at least 2 ppmw As, that a larger proportion of the arsenic contained in the resulting fuel composition will be retained in the ash produced by the combustion thereof than is retained when said fuel is combusted under identical conditions without the added metal component. Thus, when a fuel such as a shale oil, which, when burned alone, will retain essentially no arsenic in the ash thereof, is combined with a preferred Mg containing additive, such as Mg naphthenate, a fuel composition is produced which, when combusted, will leave an ash that retains substantial proportions of the arsenic therein. The addition of both Mg and Zn additives to arsenic containing fuels will not only result in the retention of arsenic in the ash, but also in retaining it in a form that is water insoluble and/or unleachable.

It is contemplated that the invention will be most utilitarian for power plants and the like that use bag filters, electrostatic precipitators, or other mechanical or electromechanical devices that remove ash particulates from flue gases. The combination of the Mg and Zn additives with arsenic containing fuels should also be of benefit inasmuch as the residual ash particulates not entrapped by electrostatic precipitators will not be of annoyance to the local vicinage.

DETAILED DESCRIPTION OF THE INVENTION

The raw fuels contemplated herein include broadly all liquid or solid carbonaceous or hydrocarbonaceous fuels containing at least about 2 ppmw of arsenic. Especially contemplated herein are synthetic hydrocarbon crudes, or fractions thereof, obtained from oil shale, solid coal, and tar sand. Arsenic concentrations in these materials normally exceed about 20 ppmw and will vary, for example, from about 20 to about 80 ppmw for shale oils and from about 25 to about 300 ppmw for coal tar distillates. Also contemplated as a fuel herein are those coals or cokes containing at least about 20 ppmw arsenic.

Broadly speaking, a fuel composition of the invention is produced when any, or a combination of any, of the aforementioned raw fuels are combined with a sufficient amount of one or more of the metals Mg, Ni, Ba, Zn, or compounds thereof, such that the proportion of arsenic emitted as a sublimate during the combustion of the resulting fuel composition is smaller, preferably substantially smaller, than that obtained when the corresponding raw fuel is burned under the same conditions. The additives suitable for use herein are extremely numerous. The proper choice thereof will depend upon the nature of the fuel to which it is added, the amount of the arsenic desired to be retained in the ash, and the manner in which it is desired to add the metallic components (e.g., in a fuel storage tank or at the burner itself). In general, however, the suitable additives consist of one or more components selected from the class consisting of the metals Mg, Ni, Zn, and Ba, the oxides thereof, and the compounds thereof that react with oxygen to produce an oxide of the metal at a temperature of combustion, normally between about 900° and 2500° F. In general, preferred additives include Mg, Ni, Zn, and Ba oxides, hydroxides, and organometallic compounds of said metals, especially the acetates and naphthenates thereof.

As stated hereinbefore, preferred additives depend, at least to some extent, upon the nature of the fuel itself. For liquid or solid hydrocarbonaceous fuels (i.e. fuels having a hydrogen/carbon atom ratio of at least about 0.5/1) the preferred additives include those organic compounds of Mg, Ba, Zn, and Ni that are oil soluble or oil dispersible. Exemplary compounds include Mg, Ba, Zn, or Ni: (1 ) salts of aromatic or aliphatic acids, (2)

glyoxime, salicylaldehyde, pyridine hydroxy, or quinoline hydroxy derivaties, or (3) diketones. Also representative of suitable additives capable of utilization with such fuels include the oil-soluble or oil-dispersible Mg, Ba, Zn, or Ni salts of: (1) the fatty acids of at least 5 carbon atoms, e.g., valeric, caproic, 2-ethylhexanonic, oleic, palmitic, stearic, linoleic, tall oil, and the like; (2) oil-soluble alkylaryl sulfonic acids, e.g., oil soluble petroleum sulfonic acids and dodecylbenzenesulfonic acid; (3) long chain alkylsulfuric or alkylphosphoric acids, e.g., a lauryl sulfuric (or phosphoric) acid; (4) petroleum naphthenic acids; (5) rosin and hydrogenated rosin; (6) alkyl phenols, e.g., iso-octyl phenol, t-butylphenol and the like; (7) alkylphenol sulfides, e.g., bis-(iso-octyl phenol)monosulfide, bis(t-butylphenol) disulfide, and the like; and (8) oil-soluble phenolformaldehyde resins, e.g., the Amberols, such as t-butylphenolformaldehyde resin, and the like. Since the salts or soaps of such acidic organic compounds as the fatty acids, naphthenic acids, and rosins are readily available or can easily be prepared, these are preferred materials. Particularly preferred are the naphthenates, oleates, tallates (tall oil soaps), and rosinates of the aforementioned metals.

For synthetic fuel oils, or other hydrocarbonaceous fuels that contain at least about 1–2% (by weight) of polar oxygenated and/or nitrogenated organic compounds, an even greater range of additives, including inorganic compounds, fall in the preferred category. The oxygenated organic compounds usually found in synthetic fuels, such as shale oils, include ketones, carboxylic compounds, carbonyl compounds, and substituted furfural compounds; the nitrogenated organic compounds found in such fuels usually include the non-basic nitrogen compounds, such as derivaties of pyrolle, and/or the basic nitrogen compounds, such as derivatives of pyridine, amines, quinolines, and the like. Generally speaking, the numerous organo-metallic compounds previously specified for use in other hydrocarbonaceous fuels, as well as inorganic compounds, are more soluble or more dispersible in such synthetic fuels. Representative preferred compounds for use therein include the acetates, hydroxides, halides (especially anhydrous halides), nitrates, oxides, chlorates, and nitrates of the aforementioned metals. Especially preferred compounds include the Mg, Ba, Zn, or Ni acetates, laurates, naphthenates, oleates, quinolates, salicylates, benzoates, oxides, and hydroxides.

Any conventional means may be employed for dissolving and/or dispersing the additive in the fuel to achieve a substantially uniform distribution thereof throughout the fuel. The insoluble additives will vary in the degree of stability of their dispersions. Insoluble additives which do not form sufficiently stable dispersions for storage or shipping purposes (e.g. the carbonate salts) may be blended with the fuel at a point upstream of the burner, so that a dispersion is achieved and maintained by the turbulence within the conduit or other means transporting the fuel into said burner. Blending in this manner can be utilized with any of the foregoing additives.

Incorporation of the additives into solid or semisolid hydrocarbonaceous fuels, such as residual shale oils, is accomplished in several ways. The additives can be suspended or dissolved in the liquid crude oil stock from which the solid residual fuel was derived, and the mixture can then be subjected to distillation to produce the solid residual fuel. For example, in the production of a pitch by the deep vacuum reduction of crude shale oil, magnesium naphthenate is slurried with the oil in proportion to the As content thereof, and the whole subjected to deep vacuum reduction to obtain a pitch containing uniformly dispersed magnesium naphthenate. Alternatively, the residual fuel is heated to temperatures sufficient to liquefy the same and then, as with any liquid fuel, combined with the additive by dispersion and/or dissolution. The fuel is then maintained at liquefying temperatures or cooled to solidifying temperatures, as desired.

Suitable additives available for use herein with carbonaceous materials (i.e. materials having a hydrogen/carbon atom ratio of less than about 0.5/1) depend firstly upon the method chosen for combining the additive with said carbonaceous materials. Dry mixing of an additive with coarsely ground coal, for example, allows for the use of any of the above disclosed additives. However, if it is desired to spray impregnate the additive in a water or oil solution or dispersion, then the preferred additives will be those which are capable of being dissolved in the liquid medium, or of forming stable dispersions therein.

The amount of the additive to be added to hydrocarbonaceous fuels to produce the preferred fuel compositions depends mainly upon the proportion of As in the fuel composition desired to be retained in the ash thereof. The approximate minimum atomic ratios of additive metal to arsenic in the fuel required for various degrees of arsenic retention in the ash are as follows:

Table I

| Degree of Arsenic Retention in Ash | Atomic Ratio of Additive Metal to Arsenic | | | |
|---|---|---|---|---|
| | Mg/As | Zn/As | Ni/As | Ba/As |
| 20% | 1/2 | 1/1 | 1/1 | 3/2 |
| 50% | 5/4 | 2/1 | 7/4 | 9/2 |
| 75% | 2/1 | 5/1 | 5/1 | 10/1 |

Those skilled in the art will understand that mixed-metal additives will be used in proportions approximating an arithmetic average of the proportionate effectiveness of the individual metal components. There is seldom if ever a need to utilize additive metal/arsenic atomic ratios greater than about 50/1. Any ratio above about 0.5/1 will be effective in some degree.

The relatively poor performance of Ba is believed to be due to its combining with the sulfur in the fuel to form $BaSO_4$, the formation of which depletes the Ba available for retaining arsenic in the ash. The use of low sulfur fuels (<0.5 wt.% S) substantially improves the performance of Ba containing components. Mg, on the other hand, is the most active metal for purposes herein, and, therefore, it and its compounds are the preferred additives. A ratio of 5/1, Mg/As, will virtually eliminate arsenic emissions from the hydrocarbonaceous fuel compositions of the invention.

The retention of arsenic in the ash of the fuel compositions containing a substantial proportion of a solid carbonaceous material like coal or coke is more difficult to achieve than the retention of arsenic in the ashes of other fuel compositions. The primary reason for this resides in the difficulty in producing a truly homogeneous mixture of the coal and the additive component, especially if the coal has not been pulverized to a mesh size below about 60. Even when such is the case, fuel compositions produced therefrom will seldom be as homogeneous as those produced from a liquid or liquefiable hydrocarbonaceous fuel. As a result, the combustion of fuel compositions consisting essentially of carbonaceous fuels and additive will tend to produce more arsenic sublimate than is likely from a hydrocarbonaceous fuel of the same metal/arsenic atomic ratio. Thus, for those fuel compositions containing a substantial proportion of a solid carbonaceous material, the atomic ratios of metal/arsenic should be approximately doubled in order to obtain a comparable arsenic retention in the ash thereof. For example, to retain about 75% of the arsenic in a fuel composition comprising coal, sufficient of a Mg component must be present to provide a Mg/As atomic ratio of between about 4/1 and 20/1.

It is noted that most naturally occurring and synthetically produced fuels containing arsenic also contain Mg, Ni, Ba, and Zn, which contained metals aid in the retention of arsenic. A typical crude Colorado shale oil, for example, contains about 0.01 ppmw Ni, 0.01 ppmw Zn, 5.0 ppmw Mg, and 0.06 ppmw Ba. When burned, these, and most other hydrocarbonaceous fuels containing such insubstantial concentrations of the aforesaid metals, seldom will produce ashes retaining more than 3%, rarely more than 5%, of the arsenic contained in said fuels. On the other hand, some coals contain in excess of 0.02 wt.% of total Mg, Ba, Zn, and Ni; thus, when combusted, the resulting ash tends naturally to retain appreciable proportions of arsenic. In any event, whether the fuel is of a hydrocarbonaceous or carbonaceous nature, the invention is directed only to those fuel compositions containing at least some added metal component. Moreover, for purposes of determining the atomic ratios hereinbefore specified, the term "additive metal" includes the metal or metals actually added plus any Mg, Zn, Ni, or Ba naturally occurring in the fuel.

Although the use of Mg components alone gives most effective retention of arsenic in the ash of the combusted fuel compositions, it has also been found that the use of Zn produces an ash that contains essentially no water soluble or water leachable arsenic compounds. Data presented hereinafter in Example II confirm this. This finding is of importance because in many instances the ash produced by the fuel composition will be sent to the atmosphere at the combustion site. If the arsenic in the ash can be rendered water insoluble, it will cause few, if any deleterious effects in the soils on which it lands. Hence, a preferred additive combination is one comprising Mg and Zn components. Preferably, the amounts of the two components so added should be such that the fuel composition produced thereby contains Zn and Mg in an atomic ratio of at least about 1/1, Zn/Mg, even more preferably at least about 2/1, Zn/Mg. It is also preferred that in such compositions the Mg/As atomic ratio be in excess of 2/1.

The following examples are provided to illustrate the invention. However, they should not be construed as limiting the invention, which is defined by the claims.

EXAMPLE I

A 650° F+ bottom fraction of a crude Colorado shale oil of composition and properties shown in Table II was utilized as the fuel to produce fuel compositions of the invention.

TABLE II

| Crude Shale Oil Composition and Properties | | | |
|---|---|---|---|
| Gravity, ° API | 22.5 | Conradson Carbon, wt.% | 2.0 |
| Sulfur, wt.% | 0.814 | Nitrogen, wt.% 1.79 | |
| ASTM Distillation,D1160,20 F | | Metals, ppmw | |
| IBP/5 | 171/344 | As | 48.0 |
| 10/20 | 416/535 | Mg | 5.0 |
| 30/40 | 619/700 | Ni | 0.01 |
| 50/60 | 762/811 | Ba | 0.06 |
| 70/80 | 863/916 | Zn | 0.01 |
| 90/95 | 978/1020 | Ca | 20 |
| Max | 1063 | Na | 1.0 |
| Rec, vol.% | 97.8 | Al | 1.4 |

Several 4600 mg portions of this 650° F+ fraction were blended, as shown in Table III, with sufficient arsenic compounds and sufficient of the additive components to give the fuel compositions containing the indicated concentrations of arsenic and additive metals. The added arsenic was for the purpose of raising the total arsenic concentration in the fuel, and the amount of ash derived therefrom, so as to reduce the margin of analytical error involved in determining the composition of extremely small quantities of ash, a problem which could otherwise be solved only by combusting extremely large fuel samples.

Experiments were then conducted to determine the proportion of the added arsenic retained by the added metallic components in the ash of the various fuel compositions shown in Table III. Each of the fuel compositions was burned using ashless filter paper as a wick. Carbonaceous residues were eliminated by igniting the residue at 1200° F. The total weight of retained arsenic in the ash of each of the burned compositions was obtained by subtracting the weight of the additive metal in the ash (obtained by combusting the same fuel with no added arsenic) from the total weight of the calcined ash. The percent arsenic retained in the ashes of said compositions was then calculated by dividing the weight of retained arsenic by the total amount originally added. (Note: Negligible error is present in the values reported in Table III due to the practical impossibility of tracing and accounting for the minute quantity of ash — less than about 0.5 mg for each sample — derived from the original metal content of the fuel.)

As shown in Table III, the retention of arsenic in the fuel compositions ranged from 19% to 83%, depending on the additive metal used to produce the fuel composition and its atomic ratio to arsenic. Comparable experiments performed by burning compositions containing Li, K, Ca, and Al in atomic ratios between 1/1 and 4/1, of metal/As, resulted in the retention of only 3% to 10% of the arsenic contained in such compositions.

TABLE III

| As containing component | Total As added,mg., as $As_2O_3$ | Additive Solution | mg.Metal added as Monoxide | Metal/As in Fuel | Calcined Ash Total wt. in mg. | Wt. due to Additive,mg. | mg.$As_2O_3$ retained | %$As_2O_3$ retained |
|---|---|---|---|---|---|---|---|---|
| HBA[3] acid | 198.1 | None | 0 | — | 2.5 | 0 | 2.5 | 1 |
| None | 0 | 1.0M $Mg(C_2H_3O_2)_2$[1] | 80.6 | — | 88.8 | 88.8 | 0 | 0 |
| HBA acid | 99.2 | " | 80.6 | 1.99 | 171.1 | 88.8 | 82.3 | 83 |
| HBA acid | 198.1 | " | 80.6 | 1.00 | 182.2 | 88.8 | 93.4 | 47 |
| None | 0 | 1.0M $Ba(C_2H_3O_2)_2$[1] | 306.8 | — | 389.9 | 389.9 | 0 | 0 |
| HBA acid | 99.2 | " | 306.8 | 1.99 | 421.8 | 389.9 | 31.9 | 32 |
| HBA acid | 198.1 | " | 306.8 | 1.00 | 428.0 | 389.9 | 38.1 | 19 |
| None | 0 | 0.5M Zn naphthenate[2] | 81.4 | — | 83.5 | 83.5 | 0 | 0 |

TABLE III-continued

| As containing component | Total As added,mg., as $As_2O_3$ | Additive Solution | mg.Metal added as Monoxide | Metal/As in Fuel | Calcined Ash Total wt. in mg. | Wt. due to Additive,mg. | mg.$As_2O_3$ retained | %$As_2O_3$ retained |
|---|---|---|---|---|---|---|---|---|
| HBA acid | 49.8 | " | 81.4 | 1.99 | 108.2 | 83.5 | 24.7 | 50 |
| HBA acid | 99.2 | " | 81.4 | 1.00 | 110.9 | 83.5 | 27.4 | 27 |
| None | 0 | 1.27 g Zn Stearate | 162.9 | — | 180.8 | 180.8 | 0 | 0 |
| Phenylarsine oxide | 96.7 | " | 162.9 | 2.05 | 202.2 | 180.8 | 21.4 | 22[4] |
| None | 0 | 0.5M Ni naphthenate[2] | 74.8 | — | 52.0 | 52.0 | 0 | 0 |
| HBA acid | 49.8 | " | 74.8 | 1.99 | 71.2 | 52.0 | 19.2 | 38 |
| HBA acid | 99.2 | " | 74.8 | 1.00 | 71.1 | 52.0 | 19.1 | 19 |
| None | 0 | 0.5M $Ni(C_2H_3O_2)_2$[1] | 149.4 | — | 160.0 | 160.0 | 0 | 0 |
| Phenylarsine oxide | 96.7 | " | 149.4 | 2.04 | 224.3 | 160.0 | 64.3 | 67 |
| Phenylarsine oxide | 96.7 | 0.5M $Mg(C_2H_3O_2)_2$[1] + 0.5M Zn naphthenate[2] | 40.3 Mg + 81.4 Zn | 2.04 | 177.5 | 44.4 Mg + 83.5 Zn | 49.6 | 52 |

[1]In glacial $HC_2H_3O_2$
[2]In Cellosolve (glycol ether)
[3]HBA acid = Hydroxybenzenearsonic acid
[4]The poor performance of Zn Stearate is believed due to non-uniform mixing of the solid stearate in the fuel.

EXAMPLE II

To demonstrate the relative effectiveness of Zn in comparison to Mg, Ni, or Ba for retaining As in an essentially water unleachable form, the following experiments were conducted. The ashes obtained from the Example I fuel compositions containing hydroxybenzenearsonic acid were each agitated in 100 ml portions of deionized water for 2 hours. The ashes were then allowed to stand in the water for 16 hours. Supernatant liquor was then removed and analyzed by X-ray fluorescence techniques (as described in *Analytical Chemistry,* Vol. 40, pp 2230–2, (1968)) to determine the concentration of arsenic as As present therein. The results were as follows:

TABLE IV

| Shale Oil Additive | Metal/As in Fuel | Ash Weight, mg. | Dissolved As, ppmw |
|---|---|---|---|
| $Mg(C_2H_3O_2)_2$ | 1.99 | 171.1 | 45 |
| $Mg(C_2H_3O_2)_2$ | 1.00 | 182.2 | 50 |
| Zn Naphthenate | 1.99 | 108.2 | 0.3 |
| Zn Naphthenate | 1.00 | 110.9 | 0.2 |
| Ni Naphthenate | 1.99 | 71.2 | 6.1 |
| Ni Naphthenate | 1.00 | 71.1 | 6.1 |
| $Ba(C_2H_3O_2)_2$ | 1.99 | 421.8 | 44 |
| $Ba(C_2H_3O_2)_2$ | 1.00 | 428.0 | 39 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

I claim:

1. A fuel composition comprising a shale oil or fraction thereof containing between 2 and 80 ppmw As, and uniformly blended therewith by dissolution one or more added metallic components selected from the class consisting of the metals, Mg, Ba, Zn, Ni, and the compounds thereof in an additive metal/arsenic atomic ratio in the range of 0.5/1 to 50/1, said components being added such that a larger proportion of the As contained in said fuel composition is retained in the ash produced by the combustion thereof than is retained in the ash produced by the combustion of said shale oil under the same conditions.

2. A fuel composition as defined in claim 1 wherein said one or more metallic components are selected from the class consisting of Mg metal, the oxides thereof, and the compounds thereof that react with oxygen to produce an oxide of Mg at temperatures between about 9000° and 2500° F, said one or more metallic components being present in said fuel composition in an atomic ratio of Mg/As of at least about 2/1.

3. A fuel composition as defined in claim 2 wherein the atomic ratio of Mg/As is at least 5/1.

4. A fuel composition as defined in claim 1 wherein said one or more metallic components comprise Mg and Zn metals, the oxides thereof, and the compounds thereof that react with oxygen to produce the oxides thereof at temperatures between about 900° and 2500° F, said one or more metallic components being present in said fuel composition in proportions such that the atomic ratio of Mg/As is at least 2/1 and the atomic ratio of Zn/Mg is at least b 1/1.

5. A fuel composition as defined in claim 4 wherein said Mg and Zn components are present as the acetates or naphthenates thereof.

6. A fuel composition comprising a solid carbonaceous material containing at least 2 ppmw As, said solid carbonaceous material being intimately commingled with one or more added metallic components selected from the class consisting of the metals of Mg, Ni, Zn, and Ba, the oxides thereof, and the compounds thereof that react with oxygen to produce an oxide of said metals at temperatures between about 900° and 2500° F such that said fuel composition contains Mg, Ni, Zn, Ba, or combinations thereof in an additive metal/arsenic atomic ratio in the range of 1/1 to 100/1.

7. A fuel composition as defined in claim 6 wherein said one or more metallic components are selected from the class consisting of Mg metal, the oxides thereof, and the compounds thereof that react with oxygen to produce an oxide of Mg at temperatures between about 900° and 2500° F, said one or more metallic components being present in said fuel composition in an atomic ratio of Mg/As of at least 2/1.

8. A fuel composition as defined in claim 7 wherein the atomic ratio of Mg/As is at least 5/1.

9. A fuel composition as defined in claim 7 containing sufficient Zn such that the atomic ratio of Zn/Mg therein is at least about 1/1.

* * * * *

UNITED STATES PATENT OFFICE

CERTIFICATE OF CORRECTION

Patent No. 4,040,797 Dated August 9, 1977

Inventor(s) Dean Arthur Young

It is certified that error appears in the above-identified patent and that said Letters Patent are hereby corrected as shown below:

Column 8, line 23, (claim 2) "9000°" should read --900°--;

Column 8, line 36, delete "b".

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*